US010472913B2

(12) United States Patent
Robertson et al.

(10) Patent No.: US 10,472,913 B2
(45) Date of Patent: Nov. 12, 2019

(54) APPARATUS AND METHODS FOR OVERCOMING AN OBSTRUCTION IN A WELLBORE

(71) Applicant: Robertson Intellectual Properties, LLC, Mansfield, TX (US)

(72) Inventors: Michael C. Robertson, Arlington, TX (US); William F. Boelte, New Iberia, LA (US); Douglas J. Streibich, Forth Worth, TX (US)

(73) Assignee: MCR OIL TOOLS, LLC, Arlington, TX (US)

( * ) Notice: Subject to any disclaimer, the term of this patent is extended or adjusted under 35 U.S.C. 154(b) by 171 days.

(21) Appl. No.: 15/444,099

(22) Filed: Feb. 27, 2017

(65) Prior Publication Data

US 2017/0167216 A1 Jun. 15, 2017

Related U.S. Application Data

(63) Continuation-in-part of application No. 13/815,694, filed on Mar. 14, 2013, now Pat. No. 9,580,984.

(51) Int. Cl.

| | |
|---|---|
| ***E21B 31/00*** | (2006.01) |
| ***E21B 31/06*** | (2006.01) |
| ***E21B 29/02*** | (2006.01) |

(52) U.S. Cl.

CPC ..... *E21B 31/002* (2013.01); *E21B 29/02* (2013.01); *E21B 31/06* (2013.01)

(58) Field of Classification Search

CPC . E21B 7/007; E21B 29/02; E21B 7/18; E21B 43/11; E21B 43/114; E21B 43/116; E21B 29/00; E21B 33/12; E21B 33/1204

See application file for complete search history.

(56) References Cited

U.S. PATENT DOCUMENTS

| | | | | |
|---|---|---|---|---|
| 4,619,318 | A * | 10/1986 | Terrell | E21B 29/02 166/212 |
| 5,287,920 | A * | 2/1994 | Terrell | E21B 17/1021 166/212 |
| 8,256,521 | B2 * | 9/2012 | Swor | E21B 23/06 166/376 |
| 2011/0285155 | A1 * | 11/2011 | Nelson | E21B 17/1078 294/65.5 |

* cited by examiner

*Primary Examiner* — Brad Harcourt

(57) ABSTRACT

Apparatus and methods for penetrating a downhole target within a wellbore include providing a body with a longitudinal axis, a first end, and a second end into a wellbore, the body having a nozzle at the first end. The nozzle is adapted to project a medium in a direction generally parallel to the longitudinal axis to affect a downhole target. An actuator in communication with the medium is usable to initiate the apparatus. The nozzle can be provided with a geometry configured for projecting the medium in a pattern that separates the downhole target into at least two portions. The medium can include a ferromagnetic material that becomes associated with the downhole target to facilitate recovery of the target or portions thereof using a retrieval device having a magnetic element.

26 Claims, 9 Drawing Sheets

APPARATUS AND METHODS FOR OVERCOMING AN OBSTRUCTION IN A WELLBORE

CROSS-REFERENCE TO RELATED APPLICATIONS

The present application is a continuation-in-part application that claims the priority benefit of the prior-filed, co-pending United States patent application having U.S. patent application Ser. No. 13/815,694, filed Mar. 14, 2013, which is incorporated by reference herein in its entirety.

FIELD

Embodiments usable within the scope of the present disclosure relate, generally, to systems and methods usable to penetrate and/or otherwise overcome a downhole target and/or obstruction in a wellbore, and more specifically, to devices and methods for projecting a medium in a direction generally parallel to the axis of a wellbore (e.g., in an uphole or downhole direction) to remove, reduce, and/or otherwise affect debris, a downhole tool, or other similar obstructions and/or restrictions, and to subsequently retrieve debris resulting from such operations when desired.

BACKGROUND

When drilling, completing, and/or otherwise forming or operating on a wellbore, it is often necessary to install and/or set devices that block, seal, restrict, or isolate a portion of the wellbore. For example, sub surface safety valves (which typically include a flapper valve), are deployed to restrict the egress of lower zoned material (e.g., oil and gas); however, it is common for flapper valves to become blocked or otherwise hindered or prevented from opening, preventing production or other operations. In other situations, foreign objects (e.g., "fish"), debris, and/or other objects, can become lodged within a wellbore, especially at restrictions in a wellbore. Such items can often present difficulties in their removal due to the lack of fixation of the object in the wellbore and/or the material of the object (e.g., Inconel, Hastalloy, etc.)

Conventional methods for removing downhole obstructions include use of jars to apply a physical/mechanical force to such obstructions, pigs or similar fluid jetting systems typically used to clean a conduit (e.g., to remove paraffin or similar substances), and other similar systems that generally rely on physical/mechanical force to forcibly move an obstruction.

Prior-filed U.S. application Ser. No. 13/815,614 relates to apparatus and methods for at least partially removing an obstruction (e.g., a downhole target) from a wellbore, e.g., by penetrating the downhole target with a medium, such as molten fuel, a perforating jet or object, a blade, a corrosive medium, or other similar means for eroding, penetrating, perforating, and/or otherwise overcoming a blockage or restriction. The nozzle geometry of such a device can be varied depending on the nature of the wellbore, the medium used, and the downhole target, to facilitate overcoming the obstruction, and when desired and/or necessary, an operation may include multiple trips in which each successive trip utilizes an apparatus having a different nozzle geometry to progressively remove an obstacle and/or enlarge an opening.

A need exists for apparatus and methods for removing certain types of obstructions, such as flapper valves and other types of downhole tools, using a reduced number of trips. For example, certain types of obstructions, such as flapper valves, could be penetrated and/or otherwise affected in a manner that allows the resulting pieces to fall into the wellbore, rather than progressively enlarging a flowpath through the center of the flapper value.

Many downhole tools, including flapper valves, are conventionally formed from inconel, stainless steel, and/or other generally non-ferromagnetic materials, due primarily to the fact that ferromagnetic materials can interfere with the operation of various downhole equipment, while attracting wellbore debris (e.g., filings, cuttings, etc.) that can cause deposits, occlusions, and/or build-up within a flowpath and eventually hinder or prevent proper operation of one or more tools. Fishing and/or other methods to recover debris and/or pieces of such downhole tools are often time consuming, cumbersome, and difficult.

A need also exists for apparatus and methods usable to facilitate removal of debris and/or pieces from downhole tools, e.g., using magnetic means.

Embodiments usable within the scope of the present disclosure meet these needs.

SUMMARY

Embodiments of the present disclosure relate generally to apparatus and methods usable for penetrating a downhole target (e.g., a flapper valve, a packer, a setting tool, or a similar sealing/isolating device, a safety valve, or any other type of restriction, obstruction, debris, etc.) within a wellbore. The apparatus can include a body having a longitudinal axis, a medium (e.g., a fuel load, such as thermite, a linear shaped charge, other types of explosive devices, blades, solid, fluid, and/or molten perforating materials, corrosive materials, or combinations thereof) associated with the body, and a nozzle at an end of the body. The nozzle can be adapted to project the medium in a direction generally parallel to the longitudinal axis of the body. An actuator can be provided in communication with the medium, such that actuation of the actuator causes projection of the medium through the nozzle. As such, embodiments usable within the scope of the present disclosure can project a medium in a downhole and/or uphole (e.g., axial) direction within a wellbore, enabling the apparatus to be placed above a blockage in a wellbore, beneath a safety valve or similar sealing device, and/or otherwise in association with a blockage or other type of obstruction that may later be overcome or removed.

The nozzle can be provided with a geometry that is configured to separate a downhole target into at least two portions, e.g., by projecting the medium in a pattern capable of separating the downhole target. For example, in an embodiment, the nozzle can have at least two slots therein, oriented such that projection of the medium separates the downhole target into a plurality of wedge-shaped portions. Such an embodiment can be used, e.g., to remove a flapper valve from a wellbore, using a smaller number of trips than other methods of removing and/or overcoming a flapper valve. For example, separation of a flapper valve into multiple, wedge-shaped portions can cause the separated portions to fall into the wellbore, thereby overcoming the obstruction in a manner that liberates the full diameter of the wellbore, in a smaller number of trips than other alternatives.

In situations where it is desirable to retrieve the separated portions of a downhole target, embodiments usable within the scope of the present disclosure can include methods for doing so. For example, if an obstruction (e.g., a downhole tool) formed from non-ferromagnetic materials must be overcome, embodiments usable within the scope of the present disclosure can include the use of a device that projects molten thermite or a similar type of fuel that can include iron or other ferromagnetic materials. Projecting of a medium containing ferromagnetic material can adhere, coat, fuse, and/or bond the ferromagnetic material to the downhole target, e.g., by forming a ferromagnetic matrix with the material of the downhole target. The resulting association between the ferromagnetic material of the medium and the downhole target can enable the target and/or separated portions thereof to be recovered using a magnetic tool.

In an embodiment, the apparatus for penetrating a downhole target can comprise a stand-off member that can be associated with the first end of the body, wherein the stand-off member can have a dimension that provides a space between the nozzle and the downhole target. The stand-off member can be adapted to be at least partially eroded by the medium.

In an embodiment, the apparatus for penetrating a downhole target can comprise a connector that can be associated with the second end of the body, wherein the connector, a device attached to the connector, or combinations thereof, can be usable to anchor the body in a generally fixed orientation relative to the wellbore to prevent movement of the body due to actuation of the actuator, projection of the medium, or combinations thereof.

In an embodiment, a cap can be associated with the first end of the body of the apparatus and can be configured to seal the nozzle to prevent entry of contaminants. The cap can be adapted to be at least partially eroded by the medium.

Embodiments of the present invention include a method for at least partially removing an obstruction from a wellbore having an axis. The method steps include positioning a body in the wellbore at a distance from the obstruction, wherein the body can comprise a nozzle having a geometry for projecting a medium in a direction generally parallel to the axis of the wellbore, and wherein the geometry can be configured for projecting the medium in a pattern adapted to separate the obstruction into at least two portions. The method steps can continue with projecting the medium through the nozzle in the direction generally parallel to the axis of the wellbore, wherein the medium affects at least one portion of the obstruction, thereby at least partially removing the obstruction from the wellbore.

In an embodiment, the method step of positioning the body at the distance from the obstruction can comprise providing the body with a stand-off member having a dimension that provides a space between the nozzle and the obstruction.

In an embodiment, the step of consuming the fuel load to cause projection of the medium through the nozzle can cause the medium to at least partially erode the stand-off member.

The method can further comprise the step of providing a cap into association with the body, wherein the cap can be configured to seal the nozzle to prevent entry of contaminants, and wherein projecting the medium through the nozzle can at least partially erode the cap.

In an embodiment, the steps of the method can further include anchoring the body in a generally fixed orientation relative to the wellbore to prevent any movement of the body due to projection of the medium. The step of anchoring the body can comprise providing a counterforce apparatus associated with the body, wherein the step of projecting the medium through the nozzle applies a force to the body, and wherein the counterforce apparatus produces a counterforce that opposes the force such that the body remains in the generally fixed orientation relative to the wellbore. The counterforce apparatus can be provided with an output, a duration, or combinations thereof, that corresponds to the geometry of the nozzle, the force, or combinations thereof.

In an embodiment of the method, the pattern of the nozzle can comprise at least two slots, and the step of projecting the medium can separate the obstruction into a plurality of wedge-shaped portions. The medium can comprise ferromagnetic material, and the step of projecting the medium can include associating the ferromagnetic material with the obstruction, such that said at least two portions of the obstruction can be magnetically retrieved.

The embodiments of the present invention can further include a method for removing and retrieving a downhole object from a wellbore, wherein the method can comprise the steps of: contacting the downhole object with a medium comprising a ferromagnetic material, thereby associating the downhole object with the ferromagnetic material; and contacting the ferromagnetic material with a retrieval device comprising a magnetic element, thereby associating the downhole object with the retrieval device. The medium can comprise thermite, and the step of contacting the downhole object with the medium can comprise projecting molten thermite into contact with the downhole object, thereby at least partially fusing the ferromagnetic material to the downhole object.

The steps of the method can further comprise positioning a body in the wellbore at a distance from the downhole object, wherein the body comprises a nozzle having a geometry adapted to project the medium in a direction generally parallel to an axis of the wellbore, and projecting the medium through the nozzle in the direction generally parallel to the axis of the wellbore.

In an embodiment, the nozzle can comprise a geometry for projecting the medium in a pattern adapted to separate the downhole target into at least two portions associated with the ferromagnetic material. The geometry of the nozzle can comprise at least two slots, wherein the step of projecting the medium can separate the downhole object into a plurality of wedge-shaped portions associated with the ferromagnetic material. In an embodiment, the step of contacting the downhole object with the medium separates the downhole object into at least two portions associated with the ferromagnetic material.

BRIEF DESCRIPTION OF THE DRAWINGS

In the detailed description of various embodiments usable within the scope of the present disclosure, presented below, reference is made to the accompanying drawings, in which.

One or more embodiments are described below with reference to the listed Figures.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

Moreover, it will be understood that various directions such as "upper", "lower", "bottom", "top", "left", "right", and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Figure 1A:
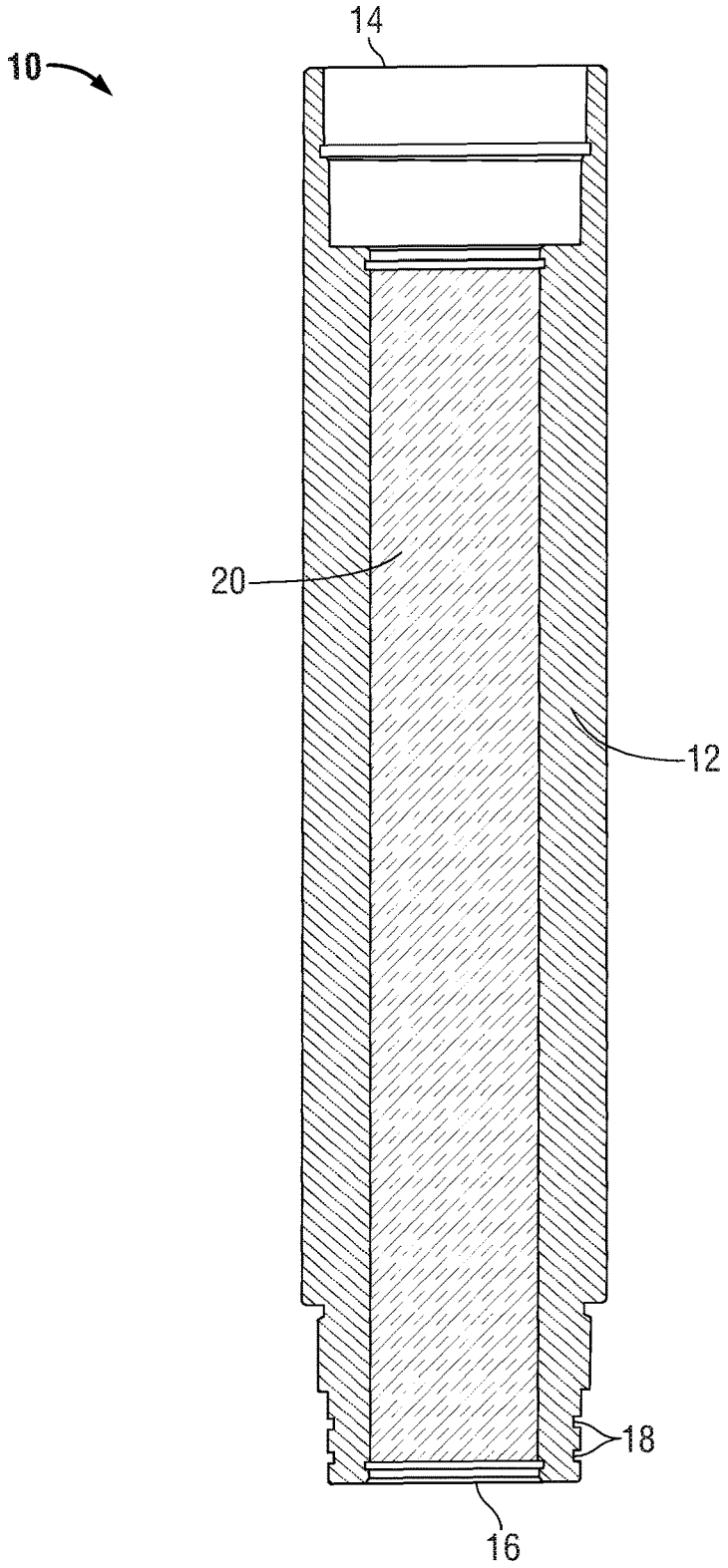
FIG. 1A depicts a cross-sectional view of an embodiment of an apparatus usable within the scope of the present disclosure.

Referring now to FIG. 1A, a cross-sectional view of an embodiment of an apparatus (10) (e.g., a torch) adapted for projecting a medium in an axial (e.g., downhole or uphole) direction within a wellbore is shown. It should be understood that while FIG. 1A depicts a generally tubular, torch-like apparatus as an exemplary embodiment, any type of cutter, perforator (e.g., a perforating gun), or any other type of device, configured to project a medium in a manner usable to affect an obstruction in a wellbore, can be used without departing from the scope of the present disclosure. Additionally, as described below, while the depicted embodiment can be used as an apparatus for projecting a medium in an axial direction within a wellbore, the depicted embodiment could alternatively be attached (e.g., threaded) to one or more other apparatus usable to project a medium in an axial direction, such that the depicted apparatus (10) is usable as an associated container for retaining a fuel load therein.

Figure 1B:
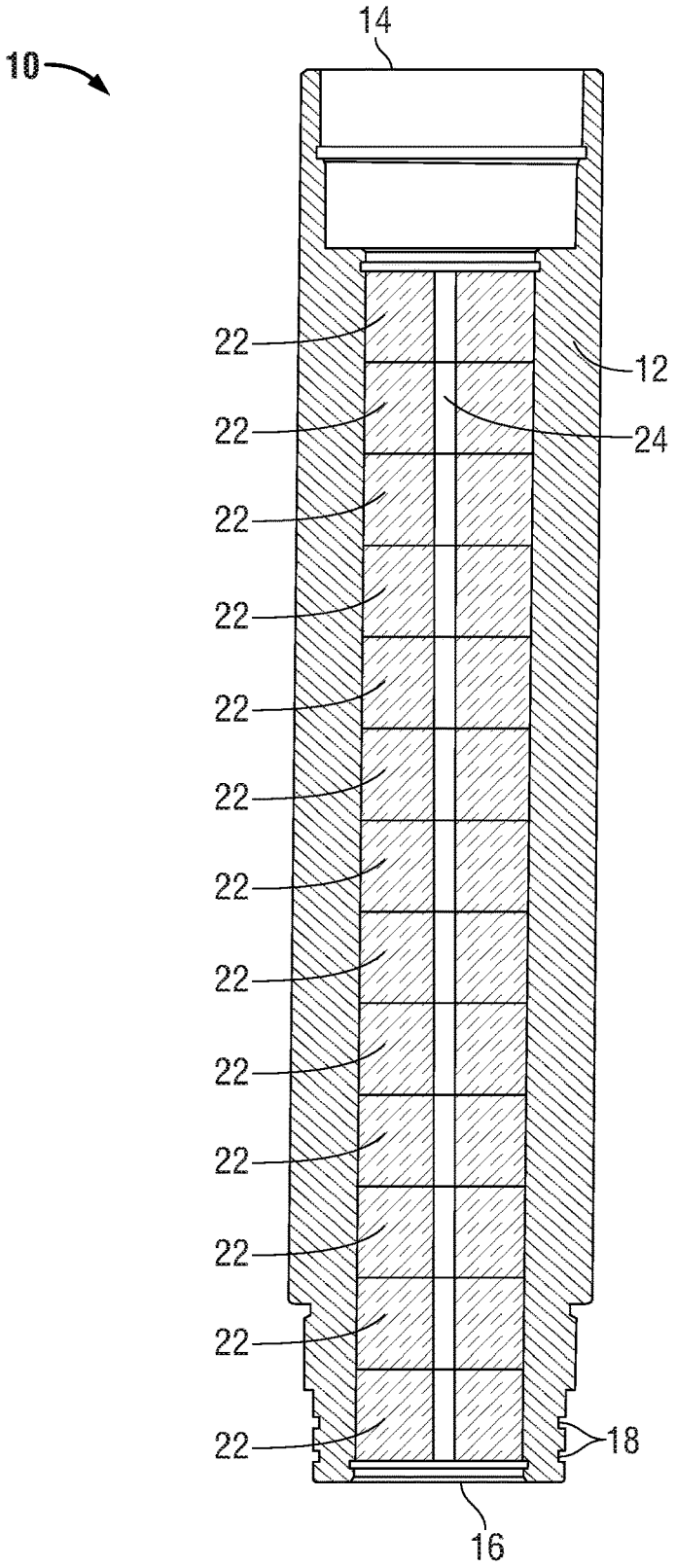
FIG. 1B depicts a cross-sectional view of an alternate embodiment of the apparatus of FIG. 1A.

Specifically, the depicted apparatus (10) is shown having an elongate, tubular body (12) having a box end (14) and a pin end (16). The pin end (16) is depicted having sealing elements (18) (e.g., O-rings or similar elastomeric and/or sealing members) associated therewith. A fuel load (20) is shown disposed within and substantially filling the central bore of the body (12). In an embodiment, the fuel load (20) can include thermite and/or a mixture of thermite and one or more polymers adapted to produce a gas and/or force as the thermite combusts, such as the power source described in U.S. Pat. Nos. 8,196,515 and 8,474,381, which are incorporated herein by reference in their entireties. FIG. 1A depicts the body (12) containing a single piece of thermite (e.g., an elongate pellet or a densely packed concentration), though it should be understood that the fuel load (20) can include any type of usable power source having any form and/or quantity. For example, FIG. 1B depicts an alternate embodiment of an apparatus (10), in which the fuel load includes multiple, discrete pellets of thermite (22), each having a central passage therethrough (e.g., for increasing surface area), to define a continuous central passage (24). In other embodiments, the fuel load could include a different type of medium usable to affect a downhole target, such as one or more blades, a corrosive medium, a solid or fluid perforating medium, or other types of generally destructive media.

In operation, the box end (14) and/or the pin end (16) of the depicted apparatus (10) can be configured to function as a nozzle, such that when the fuel load (20) is consumed (e.g., through actuation of a thermal generator or other type of ignition source or actuator), a medium (e.g., molten thermite) is projected through the nozzle, generally parallel to the axis of the body (12). The medium can subsequently affect an obstruction within a wellbore (e.g., a flapper valve, debris, a setting tool, a restriction, or other similar types of obstacles) located in an axial direction (e.g., uphole or downhole) relative to the apparatus (10), e.g., by at least partially degrading, perforating, penetrating, and/or eroding the obstruction.

As described above, however, the depicted apparatus (10) can be used in conjunction with additional containers and/or apparatus containing additional fuel, or the depicted apparatus (10) can function as a carrier for a fuel load (20) for use by an associated apparatus. Similarly, an initiation apparatus can be threaded to and/or otherwise engaged with either end (14, 16) of the apparatus (10), and/or other attachments and/or components can be engaged with the depicted apparatus (10), such as a stand-off member, an anchor and/or attachment/latching mechanism, or other similar components, as described above and below.

Figure 2A:
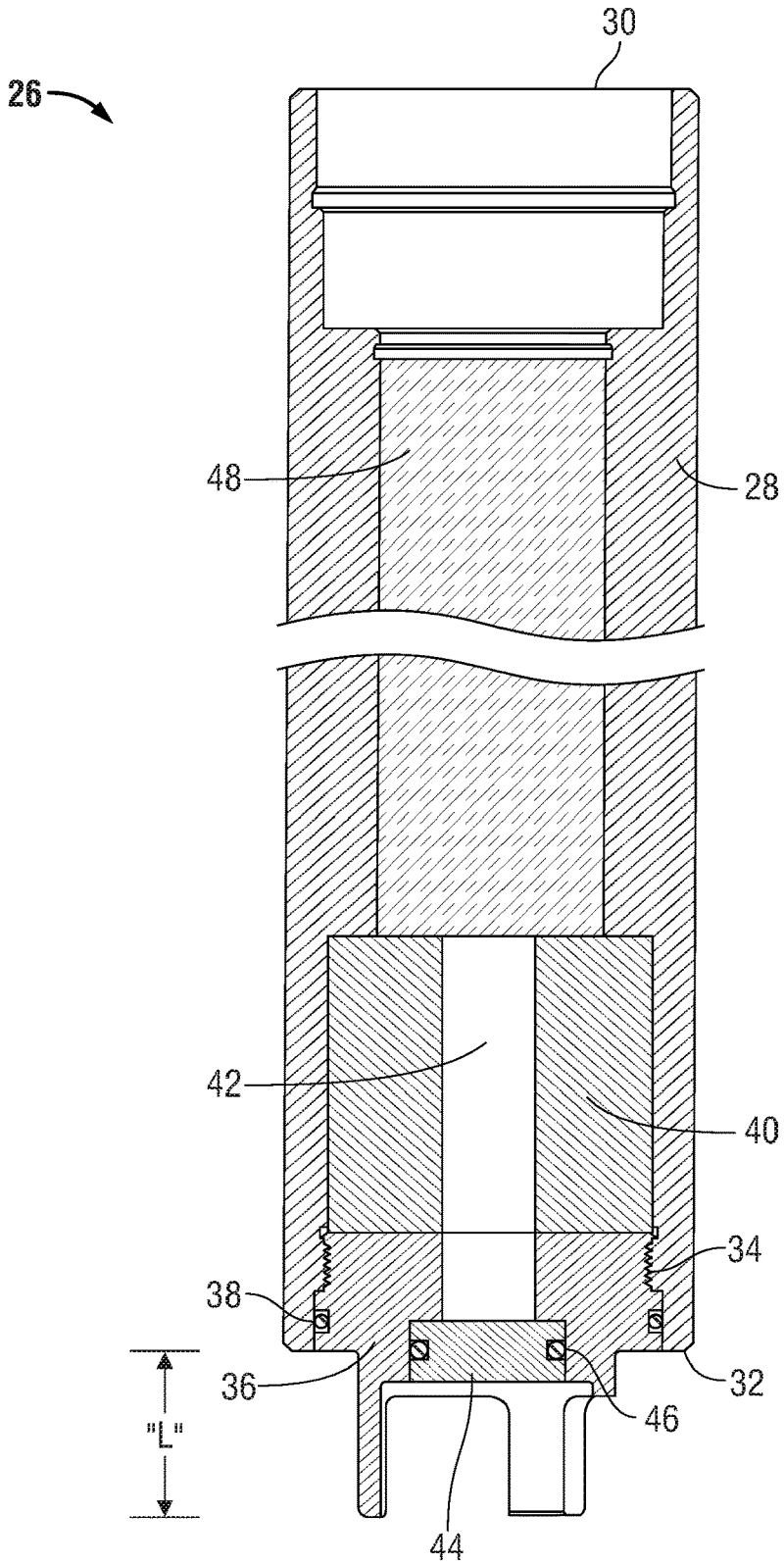
FIG. 2A depicts a cross-sectional view of an embodiment of an apparatus usable within the scope of the present disclosure.

Referring now to FIG. 2A, a cross-sectional view of an embodiment of an apparatus (26) (e.g., a torch), usable within the scope of the present disclosure is shown. The apparatus (26) is depicted having a generally tubular body (28) with a first end (30) having threads and/or a box connection, and a second end (32). The second end (32) is depicted having interior threads (34), usable for engagement with a stand-off member (36). The stand-off member (36) is shown engaged with the body (28) via the threads (34), and a sealing member (38) (e.g., an O-ring or similar element) is shown secured between the stand-off member (36) and the interior surface of the body (28). As described above, the stand-off member (36) can be usable to provide a space between the second end (32) of the body (28) and an object and/or obstruction in the wellbore, such as through contact between the obstruction and one or more protruding portions of the stand-off member (36). Specifically, FIG. 2A shows the stand-off member (36) having a plurality of protruding elements extending beyond the second end (32) of the body (28) a selected length (L), which provides an effective space between the body (28) and an obstruction in the wellbore, such that the projection of a medium from the apparatus (26) toward the obstruction will be less likely to damage and/or otherwise affect the body (28) of the apparatus (26).

The depicted embodiment of the apparatus (26) is shown having an insert (40) disposed within the body (28) proximate to the second end (32), which in an embodiment, can be formed from graphite or a similar material that will remain generally unaffected by the consumption of a fuel load and the projection of a medium. The insert (40) is shown having an internal bore, which is continuous with a bore through the stand-off member (36), defining a nozzle (42) at the second end (32) of the body (28). The stand-off member (26) is depicted having a seal and/or plug (44) engaged therewith, over the nozzle (42), with an associated O-ring or similar sealing member (46), such that the seal and/or plug (44) blocks the opening of the nozzle (42) while the apparatus (26) is lowered and/or otherwise positioned within the wellbore. The seal and/or plug (44) thereby prevent(s) the entry of contaminants into the nozzle (42) and body (28), until the apparatus (26) is actuated. Consumption of the fuel load (48), which in an embodiment, can include thermite and/or a thermite-polymer mixture, causes projection of a medium (e.g., molten thermite and/or gas) through the nozzle (42), which can remove and/or penetrate and/or otherwise degrade the seal and/or plug (44), and further affect an obstruction located external to the apparatus (26) (e.g., located in an axial direction proximate to the second end (32) thereof.)

Figure 2B:
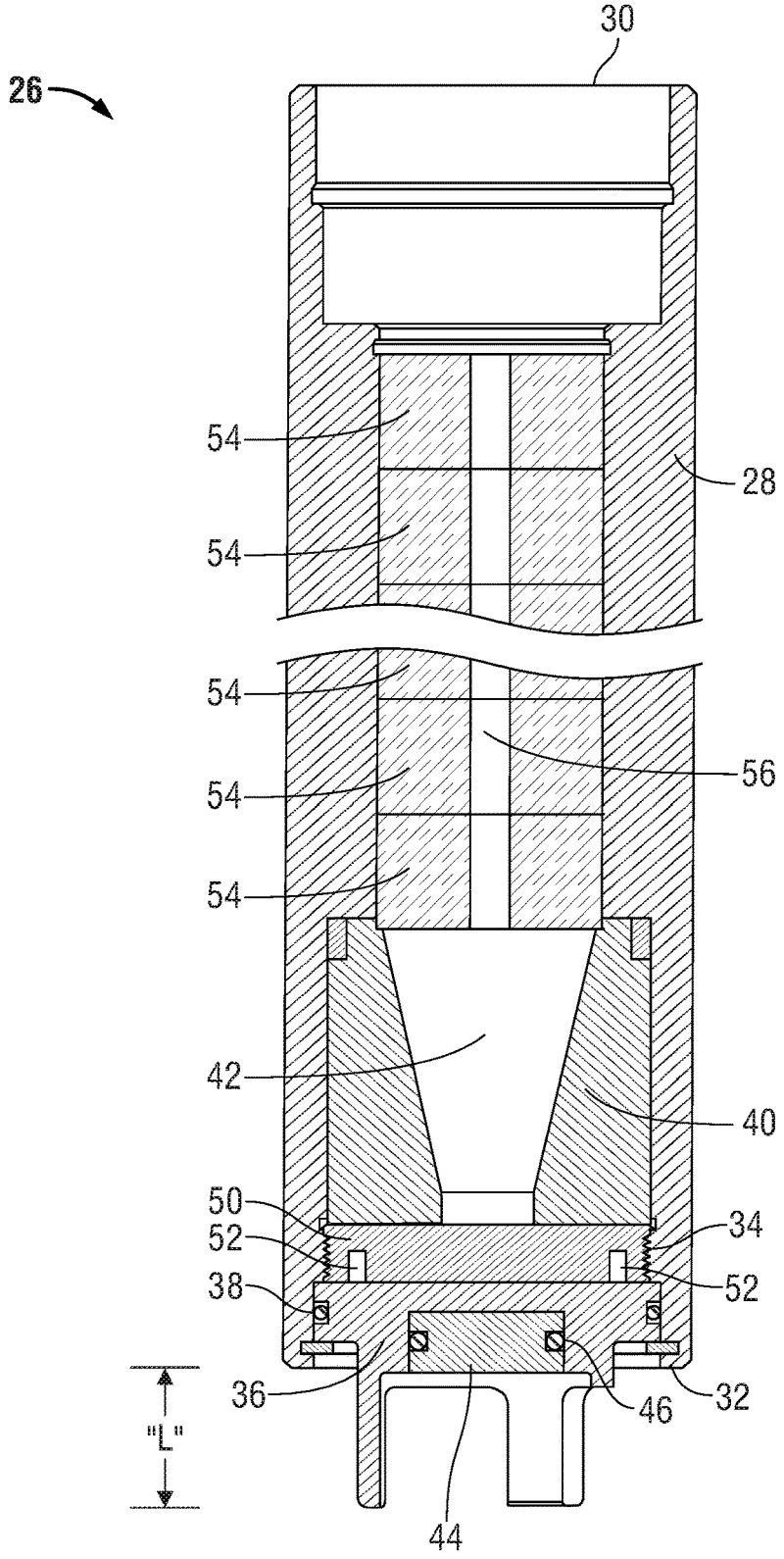
FIG. 2B depicts a cross-sectional view of an alternate embodiment of the apparatus of FIG. 2A.

It should be understood that the nozzle (42), the fuel load (48), the stand-off member (36), and other components of the apparatus (26) can be readily varied and/or provided having other dimensions, shapes, and/or forms without departing from the scope of the present disclosure. For example, FIG. 2B depicts an alternate embodiment of an apparatus (26), in which the stand-off member (36) can be adjustably secured to the body (28) by way of tightening pins and/or screws (52), which can secure the stand-off member (36) to a plug and/or retainer (50). Additionally, FIG. 2B depicts the insert (40) having a generally conical interior profile, which defines the shape of the nozzle (42), the characteristics of the medium projected therethrough, and the corresponding effect on a downhole obstruction. In various embodiments, it may be desirable to use multiple apparatus in succession, each with a differing nozzle geometry, such that actuation of a previous apparatus enhances the effect of each subsequent apparatus when used to penetrate and/or otherwise affect the obstruction. FIG. 2B also shows the fuel load including multiple discrete pellets (54) of thermite that define a continuous interior channel (56) therethrough, rather than a solid, compressed, and/or single-piece, fuel load as shown in FIG. 2A. As described above, any configuration and/or type of medium able to affect a downhole target can be used without departing from the scope of the present disclosure.

Figure 3A:
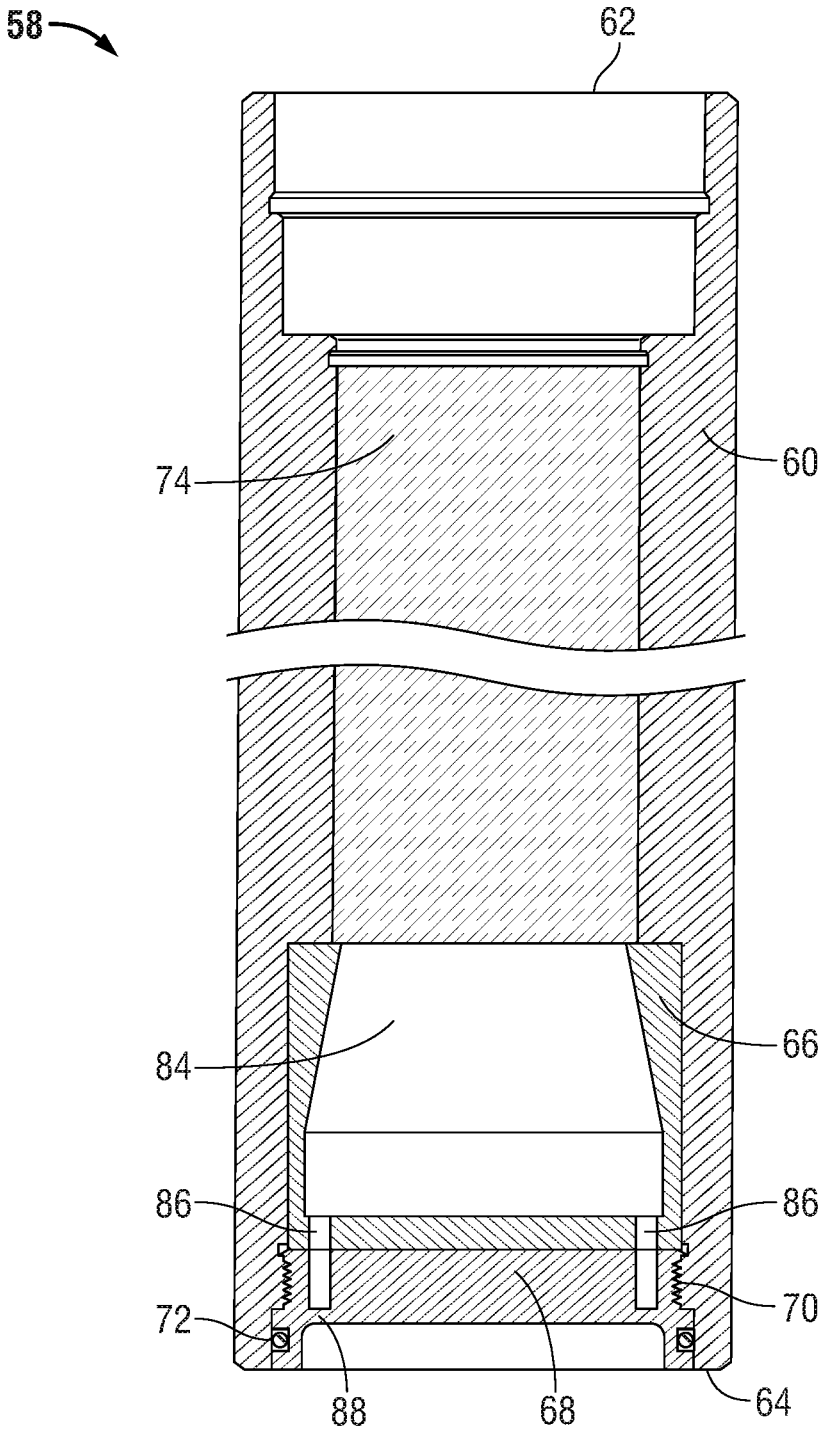
FIG. 3A depicts a cross-sectional view of an embodiment of an apparatus usable within the scope of the present disclosure.

Referring now to FIG. 3A, a cross-sectional view of an embodiment of an apparatus (58) (e.g., a torch), usable within the scope of the present disclosure is shown. The apparatus (58) is depicted having a generally tubular body (60) with a first end (62) having threads and/or another type of box connector associated therewith, and a second end (64). The body (60) is shown having an insert (66) positioned within the interior of the body (60) and proximate to the second end (64), which, in an embodiment, the insert (66) can be formed from graphite or a similar material that will remain generally unaffected by the consumption of a fuel load and the projection of and/or contact with a medium. The depicted insert (66) is shown having a generally frustoconical interior shape, with a lower portion having one or more openings therein, which defines a nozzle (84) that includes a generally broad, upper section that narrows to one or more of channels (86), which pass through the lower portion of the insert (66). A plug and/or seal (68) (e.g., a cap) is shown engaged with the second end (64) of the body, between the nozzle (84) and the exterior of the apparatus (58), via interior threads (70) within the body (60). An O-ring or similar sealing element (72) can be positioned between the plug and/or seal (68) and the body (60). The plug and/or seal (68) is shown having grooves, indentations, and/or channels that are continuous with the channels (86) within the insert (66), such that when the fuel load (74) is consumed, the medium (e.g., molten thermite) can enter the nozzle (84), pass into the channels (86), and then penetrate, perforate, and/or otherwise erode at least a portion (88) of the plug and/or seal (68), between the nozzle (84) and the exterior of the apparatus (58).

Figure 3B:
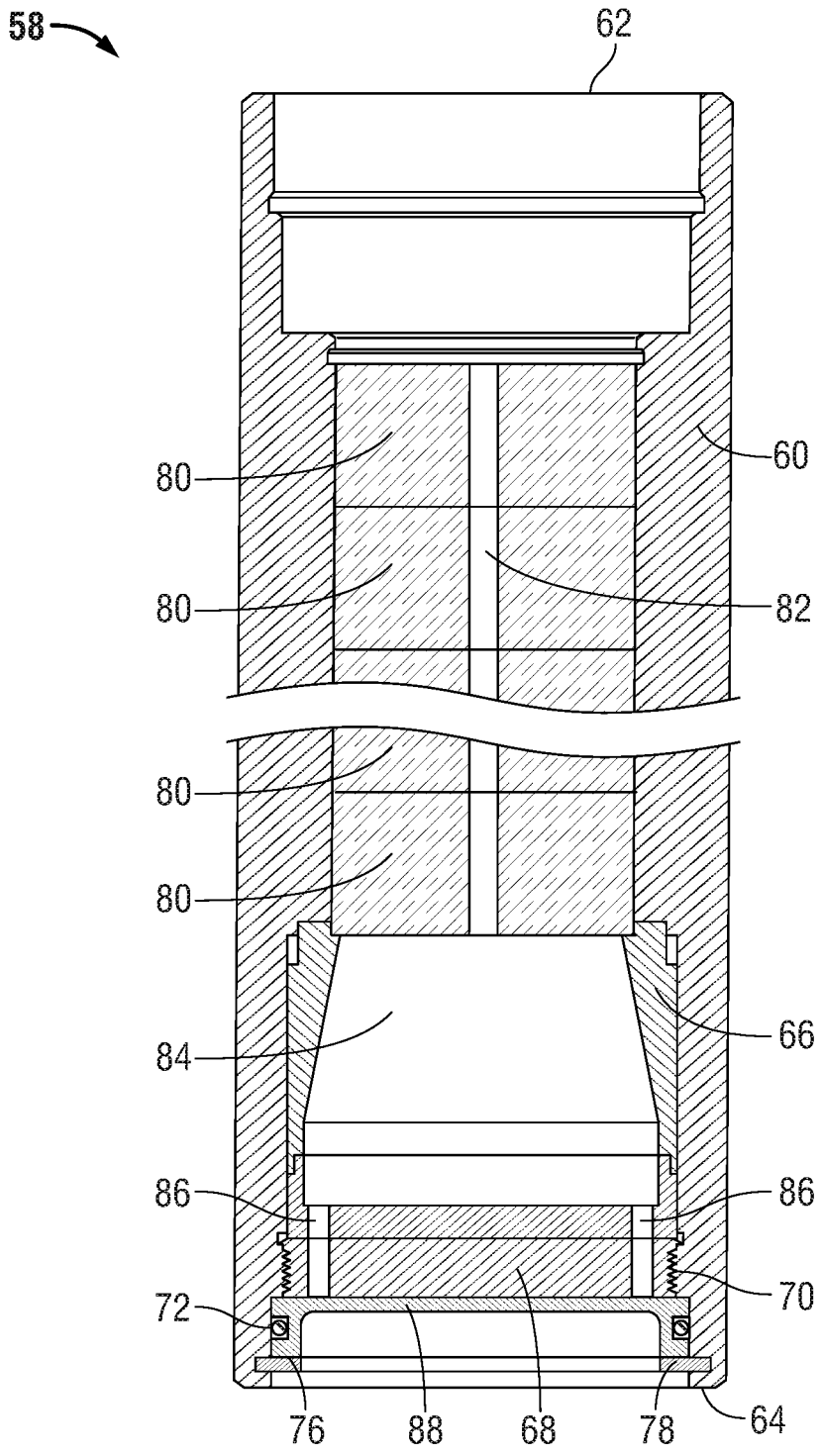
FIG. 3B depicts a cross-sectional view of an alternate embodiment of the apparatus of FIG. 3A.

It should be understood that various components of the depicted apparatus (58) can be readily modified without departing from the scope of the present disclosure. For example, FIG. 3B depicts an apparatus (58), in which the fuel load includes multiple discrete pellets (80) of thermite and/or a thermite-polymer mixture, with a contiguous central passageway (82) extending therethrough. The insert (66) is shown including a lower portion, with an angled and/or convex surface, to facilitate guiding molten thermite and/or another similar medium from the broad region of the nozzle (84) into the channels (86). Additionally, the plug and/or seal (68) is shown as a two part component in which an upper portion thereof (68) (e.g., an insert) is abutted by a plug and/or sealing member (76) of a lower portion (88), while the plug and/or sealing member (76) can be retained in place via a snap ring (78) or similar retaining member.

Each of the embodiments shown in FIGS. 1A through 3B are exemplary embodiments of apparatus usable to project a medium in a direction generally parallel to the axis of a wellbore (e.g., in an uphole and/or downhole direction); and as such, it should be understood that any type of torch, cutter, perforating device, or other similar apparatus configured to project a medium in an axial direction can be used without departing from the scope of the present disclosure.

In use, any of the above-described embodiments, and/or another similar apparatus configured to project a medium in an axial direction can be positioned within a wellbore (e.g., by lowering the apparatus via a conduit engaged with the upper end/top connector thereof). The apparatus can be anchored in place, such as through use of a positioning and latching system, such as that described in U.S. Pat. No. 8,616,293, which is incorporated herein by reference in its entirety. For example, a latching member can be engaged to an embodiment of the present apparatus via a connection to the upper end/top connector thereof. In other embodiments, various other types of anchors, setting tools, and/or securing devices can be used to retain the apparatus in a generally fixed position within a wellbore without departing from the scope of the present disclosure.

In a further embodiment, any of the above-described embodiments, and/or another similar apparatus can be positioned within a wellbore, facing a first direction (either uphole or downhole), while a second identical or similar apparatus can be provided, facing the opposite direction. The two apparatus can be actuated simultaneously, such that the force produced by the second apparatus (e.g., a counterforce apparatus), counteracts and/or otherwise opposes the force applied to the first apparatus by consumption of the fuel load and projection of the medium, thereby retaining both apparatus in a generally fixed position within the wellbore during use. The nozzle geometry, fuel load, and/or other characteristics of the second/counterforce apparatus can be selected based on the nozzle geometry, fuel load, and/or other expected forces associated with the first apparatus.

Figure 4D:
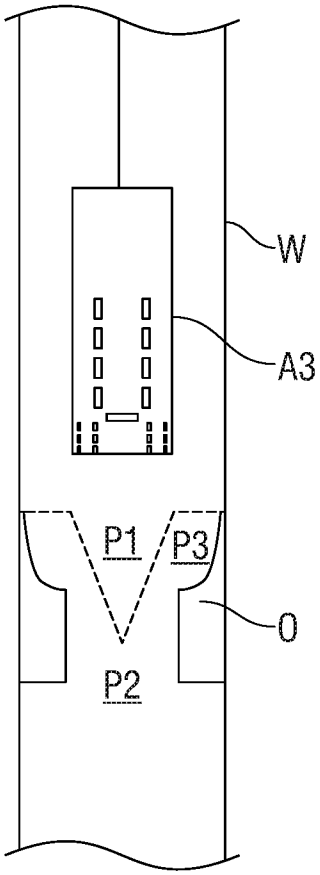
FIGS. 4A through 4D depict diagrams showing an embodiment of a method usable within the scope of the present disclosure.
Figure 4C:
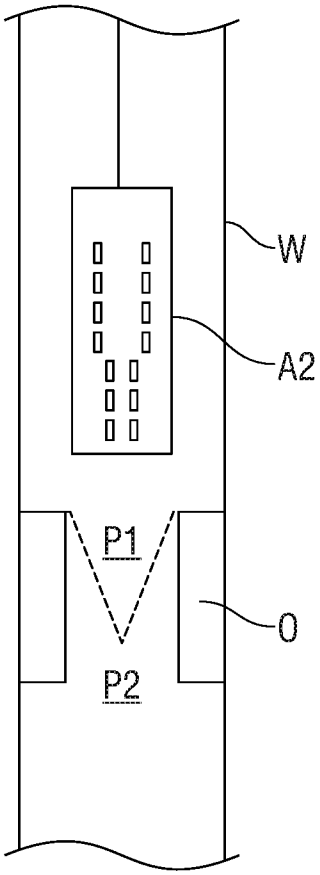

As described above, depending on the nature of an obstruction in a wellbore, it may be desirable to use multiple apparatus in succession, each having a differing nozzle geometry. For example, FIG. 4A depicts a diagram showing a portion of a wellbore (W), within which an obstruction (O) to flow and/or other operations is shown. Possible obstructions can include, by way of example, malfunctioning valves, setting and/or sealing devices, debris, or any other obstacle and/or restriction to flow through the wellbore (W).

Figure 4B:
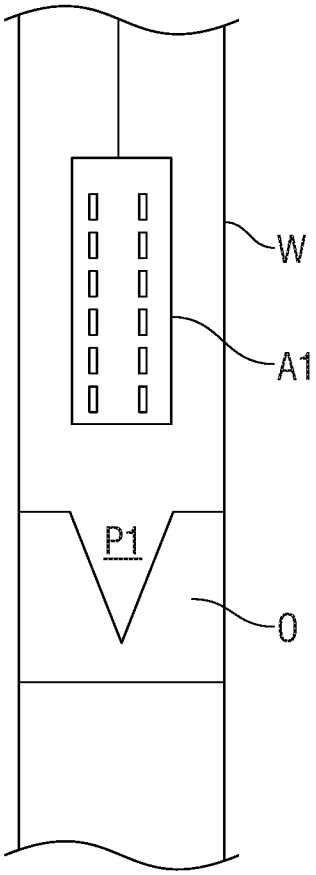
Figure 4A:
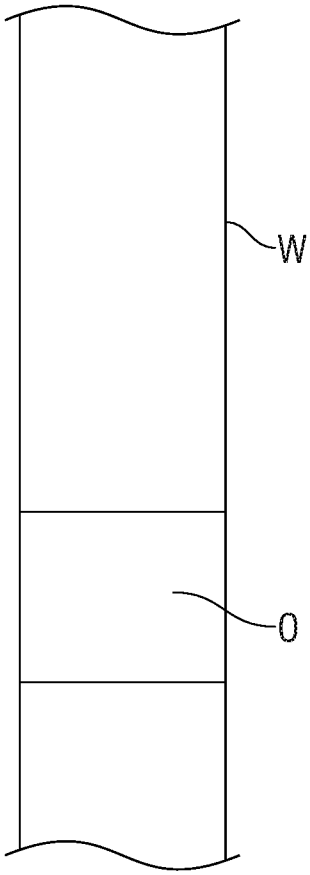

A first apparatus (A1), such as an apparatus similar to that shown in FIG. 1A, can be positioned relative to the obstruction (O), as depicted in FIG. 4B. Actuation of the first apparatus (A1), to project a medium in an axial (e.g., downhole) direction toward the obstruction (O), affects the obstruction (O) by forming a first perforation and/or erosion (P1) therein.

Following use of the first apparatus (A1), a second apparatus (A2), such as an apparatus similar to that shown in FIG. 2A, can be positioned relative to the obstruction (O), as depicted in FIG. 4C. Actuation of the second apparatus (A2) to project a medium in an axial (e.g., downhole) direction toward the obstruction (O) affects the obstruction (O) by forming a second perforation and/or erosion (P2) therein. The existence of the first perforation and/or erosion (P1) enhances the effectiveness of the second apparatus (A2), such that the combined and/or synergistic effect of using the second apparatus (A2), following use of the first apparatus (A1), exceeds the theoretical sum of the individual effectiveness of each apparatus (A1, A2).

Following use of the second apparatus (A2), a third apparatus (A3), such as an apparatus similar to that shown in FIG. 3A, can be positioned relative to the obstruction (O), as depicted in FIG. 4D. Actuation of the third apparatus (A3) to project a medium in an axial (e.g., downhole) direction toward the obstruction (O) affects the obstruction (O) by forming a third perforation and/or erosion (P3) therein. The existence of the first and/or second perforations and/or erosions (P1, P2) enhances the effectiveness of the third apparatus (A3), such that the combined and/or synergistic effect of using the third apparatus (A3), following use of the previous apparatus (A1, A2), exceeds the theoretical sum of the individual effectiveness of each apparatus (A1, A2, A3). It should be understood that the method illustrated in FIGS. 4A through 4D is a single exemplary embodiment, and that any number and/or type of apparatus can be used, in any order, without departing from the scope of the present disclosure, and that in some circumstances, use of a single apparatus can adequately overcome an obstruction, while in other circumstances, the use of more than three apparatus may be desired. Further, while FIGS. 4A through 4D depict an embodiment in which a series of apparatus (A1, A2, A3) are lowered into a wellbore (W) to affect an obstruction (O), by projecting a medium in a downhole direction, in other embodiments, one or more apparatus could be lowered into a wellbore prior to the intentional or unintentional creation of an obstruction above the apparatus (e.g., in an uphole direction therefrom). Subsequently, the one or more apparatus could be actuated to project a medium in an uphole direction to overcome the obstruction.

Figure 5A:
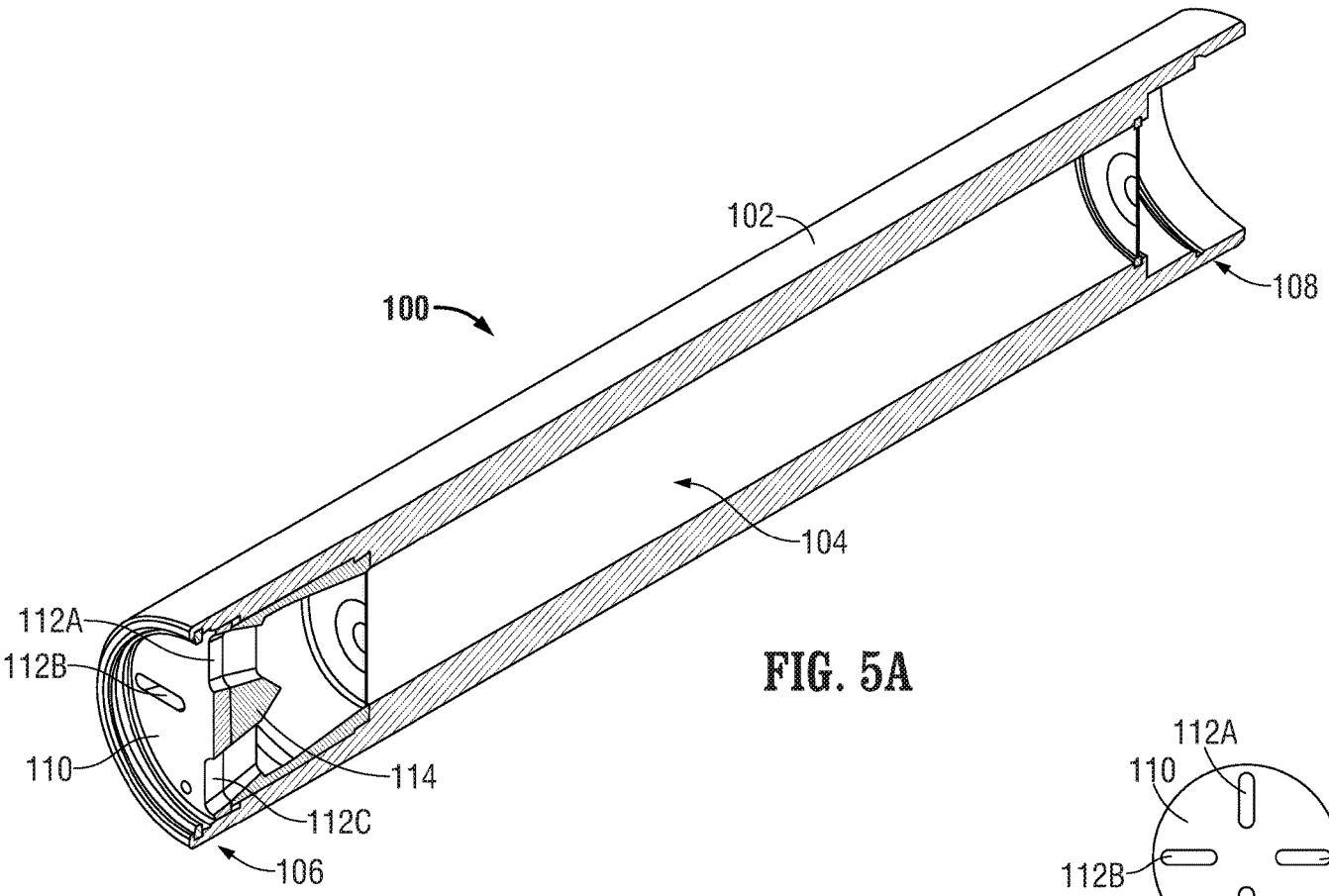
FIG. 5A depicts an isometric, partial cross-sectional view of an embodiment of an apparatus usable within the scope of the present disclosure.
Figure 5B:
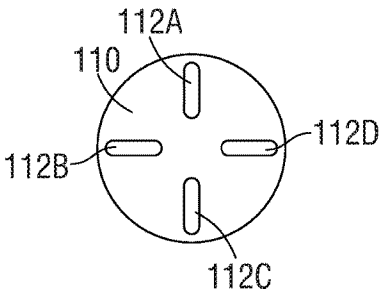
FIG. 5B depicts a diagrammatic end view of the apparatus of FIG. 5A.

Referring now to FIG. 5A, an isometric, partial cross-sectional view of an embodiment of an apparatus (100), usable within the scope of the present disclosure, is shown. FIG. 5B depicts a diagrammatic end view of the apparatus (100), while FIG. 5C depicts an isometric, partial cross-sectional view of the apparatus (100) engaged with a cap (116).

The apparatus (100) is shown having a generally tubular body (102) with a bore and/or cavity (104) therein, usable to contain a medium (e.g., a thermite-based fuel load or other types of media) for affecting a downhole target, such as a flapper valve. The body (102) includes a first end (104) having a nozzle (110) engaged therewith, and a second end (108) usable to engage the apparatus (100) to an adjacent component, connector, conduit, and/or other type of object.

The nozzle (110) is shown having a geometry adapted to separate a flapper valve or similar downhole object and/or obstruction into portions (e.g., wedge-shaped pieces). Specifically, the depicted nozzle (110) includes four slots (112A, 112B, 112C, 112D) extending in a radial direction and spaced generally equally about the face of the nozzle (110). A diverter (114) is positioned adjacent to the nozzle (110), toward the interior of the body (102).

Figure 5C:
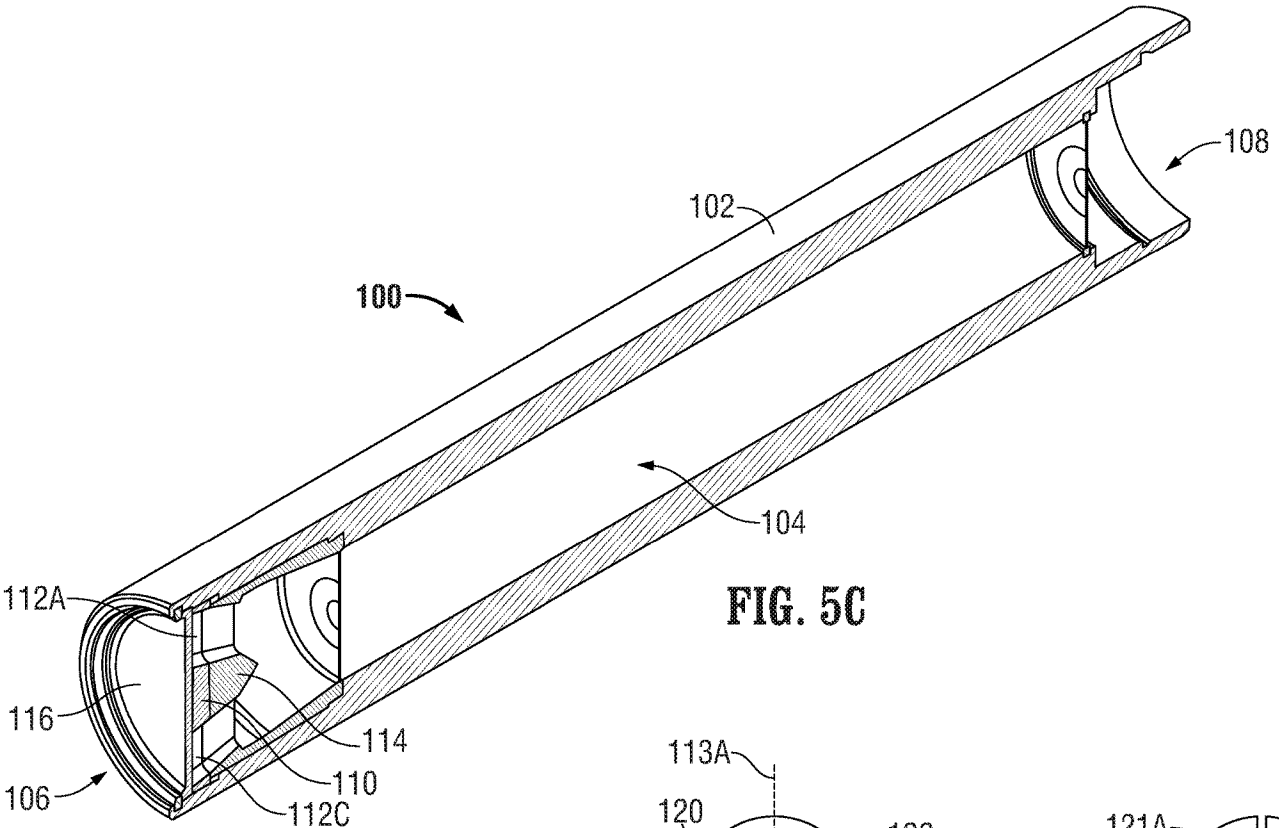
FIG. 5C depicts an isometric, partial cross-sectional view of the apparatus of FIG. 5A, having a cap engaged therewith.

FIG. 5C depicts a cap (116) engaged with the first end (106) of the body (102), e.g., for preventing the ingress of material and/or fluid into the nozzle (110), and/or into the cavity (104). In an embodiment, the cap (116) can be formed from a material that can be at least partially degraded by projection of the medium through the nozzle (110). For example, molten thermite projected through the slots (112A, 112B, 112C, 112D) could melt, cut, and/or otherwise penetrate through the cap (116) in corresponding locations thereof prior to affecting a downhole target.

In use, a medium (e.g., molten thermite) can be projected from the interior of the body (102) toward the nozzle (110), guided by the diverter (114) through the slots (112A, 112B, 112C, 112D), such that the molten thermite or similar medium that exits the apparatus (110) is projected in a pattern corresponding the position of the slots (112A, 112B, 112C, 112D), thereby affecting a downhole target by separating and/or severing the downhole target into wedge-shaped pieces generally corresponding to the portions of the nozzle (110) unoccupied by slots. For example, during typical use, projection of molten thermite through the depicted nozzle (110) would sever a flapper valve into four wedge-shaped pieces by cutting generally perpendicular slots through the valve.

Figure 6B:
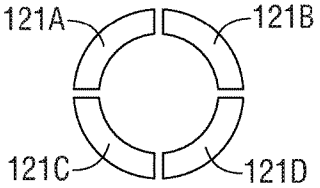
FIG. 6B depicts the downhole target of FIG. 6A after actuation of an apparatus usable within the scope of the present disclosure.
Figure 6A:
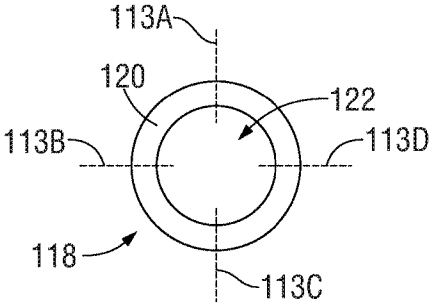
FIG. 6A depicts a diagrammatic end view of an embodiment of a downhole target prior to actuation of an apparatus usable within the scope of the present disclosure.

For example, FIG. 6A depicts a diagrammatic end view of a downhole target (118), e.g., a flapper valve, having a generally tubular body (120) with a bore (122) extending therethrough. The downhole target (118) can include other parts, such as sealing/seating elements, a flapper, a valve, etc., as known in the art. FIG. 6A illustrates the locations at which cuts (113A, 113B, 113C, 113D) can be made in the body (120), e.g., using the apparatus depicted in FIGS. 5A-5C. For example, cut (113A) corresponds to the location of the first slot (112A, shown in FIGS. 5A and 5B), cut (113B) corresponds to the location of the second slot (112B, shown in FIGS. 5A and 5B), cut (113C) corresponds to the location of the third slot (112C, shown in FIGS. 5A and 5B), and cut (113D) corresponds to the location of the fourth slot (112D, shown in FIG. 5B).

FIG. 6B depicts the downhole target after actuation of the apparatus. Specifically, FIG. 6B depicts the downhole target separated into four distinct portions (121A, 121B, 121C, 121D) after each of the cuts illustrated in FIG. 6A are formed, e.g., via projection of the medium from the apparatus. After actuation of the apparatus, the portions (121A, 121B, 121C, 121D) can fall into the wellbore (e.g., into a rat hole for disposal); however, in an embodiment, the portions (121A, 121B, 121C, 121D) can be retrieved (e.g., fished). For example, as described above, when a medium containing ferromagnetic materials, such as molten thermite, is projected into contact with the downhole target, the ferromagnetic materials can adhere, bond, fuse, coat, and/or otherwise become associated with the downhole target, e.g., by forming a matrix therewith. Subsequently, a retrieval device having a ferromagnetic element can be used to contact and retrieve the portions of the downhole target, due to the magnetic attraction between the ferromagnetic materials of the medium and the retrieval tool.

Embodiments usable within the scope of the present disclosure thereby provide apparatus and methods usable to penetrate, perforate, and/or erode a target that presents a blockage, hindrance to travel, and/or inadequate flow path in a wellbore, through the projection of a medium to affect the obstruction. Embodiments can include use of nozzles having geometries adapted for separating a downhole target, such as a flapper valve, into multiple portions, and can further include methods for applying a ferromagnetic property to previously non-ferromagnetic objects to facilitate retrieval of the objects.

While various embodiments usable within the scope of the present disclosure have been described with emphasis, it should be understood that within the scope of the appended claims, the present invention can be practiced other than as specifically described herein.

What is claimed is:

1. An apparatus for penetrating a downhole target within a wellbore having an axis, wherein the apparatus comprises:

a body having a longitudinal axis, a first end, and a second end;

a medium associated with the body;

a nozzle at the first end of the body, wherein the nozzle projects the medium in a direction generally parallel to the longitudinal axis, and wherein the nozzle comprises a surface adapted to face the downhole target, and at least two elongated slots extending in a radial direction on the surface and oriented in a geometry configured for projecting the medium in a pattern adapted to separate the downhole target into at least two portions; and an actuator in communication with the medium, wherein actuation of the actuator causes projection of the medium through the nozzle in the pattern, in the direction generally parallel to the longitudinal axis of the body and generally parallel to the axis of the wellbore for affecting the downhole target.

2. The apparatus of claim 1, further comprising a stand-off member associated with the first end of the body, wherein the stand-off member has a dimension that provides a space between the nozzle and the downhole target.

3. The apparatus of claim 2, wherein the stand-off member is adapted to be at least partially eroded by the medium.

4. The apparatus of claim 1, further comprising a connector associated with the second end of the body, wherein the connector, a device attached to the connector, or combinations thereof, anchors the body in a generally fixed orientation relative to the wellbore to prevent movement of the body due to actuation of the actuator, projection of the medium, or combinations thereof.

5. The apparatus of claim 1, further comprising a cap associated with the first end of the body, wherein the cap is configured to seal the nozzle to prevent entry of contaminants.

6. The apparatus of claim 5, wherein the cap is adapted to be at least partially eroded by the medium.

7. The apparatus of claim 1, wherein the orientation of the at least two elongated slots is such that projection of a blade, the medium or combinations thereof, separates the downhole target into a plurality of wedge-shaped portions.

8. The apparatus of claim 1, wherein the medium comprises an explosive charge, a corrosive medium, a molten medium, or combinations thereof.

9. The apparatus of claim 1, wherein the medium comprises ferromagnetic material, and wherein projection of the medium adheres, coats, fuses, bonds, or combinations thereof, the ferromagnetic material to the downhole target, thereby enabling magnetic retrieval of the at least two portions thereof.

10. The apparatus of claim 9, wherein the medium comprises thermite.

11. The apparatus of claim 10, wherein projection of the thermite forms a ferromagnetic matrix on the downhole target.

12. A method for at least partially removing an obstruction from a wellbore having an axis, the method comprising the steps of:

positioning a body in the wellbore at a distance from the obstruction, wherein the body comprises a nozzle comprising a surface adapted to face the obstruction, and at least two elongated slots extending in a radial direction on the surface and oriented in a geometry for projecting a medium in a direction generally parallel to the axis of the wellbore, wherein the geometry is configured for projecting the medium in a pattern adapted to separate the obstruction into at least two portions; and projecting the medium through the nozzle in the direction generally parallel to the axis of the wellbore, wherein the medium elects at least one portion of the obstruction, thereby at least partially removing the obstruction from the wellbore.

13. The method of claim 12, wherein the step of positioning the body at the distance from the obstruction comprises providing the body with a stand-off member having a dimension that provides a space between the nozzle and the obstruction.

14. The method of claim 13, further comprising a step of consuming a fuel load to cause projection of the medium through the nozzle, which causes the medium to at least partially erode the stand-off member.

15. The method of claim 12, further comprising the step of providing a cap into association with the body, wherein the cap is configured to seal the nozzle to prevent entry of contaminants, and wherein projecting the medium through the nozzle at least partially erodes the cap.

16. The method of claim 12, further comprising the step of anchoring the body in a generally fixed orientation relative to the wellbore to prevent a movement of the body due to projection of the medium.

17. The method of claim 16, wherein the step of anchoring the body comprises providing a counterforce apparatus associated with the body, wherein the step of projecting the medium through the nozzle applies a force to the body, and wherein the counterforce apparatus produces a counterforce that opposes the force such that the body remains in the generally fixed orientation relative to the wellbore.

18. The method of claim 17, further comprising the step of providing the counterforce apparatus with an output, a duration, or combinations thereof, that corresponds to the geometry of the nozzle, the force, or combinations thereof.

19. The method of claim 12, wherein the step of projecting the medium separates the obstruction into a plurality of wedge-shaped portions.

20. The method of claim 12, wherein the medium comprises ferromagnetic material, wherein the step of projecting the medium comprises associating the ferromagnetic material with the obstruction, and wherein the method further comprising the step of magnetically retrieving said at least two portions of the obstruction.

21. A method for removing and retrieving a downhole object from a wellbore, wherein the method comprises the steps of:

positioning a body in the wellbore at a distance from the downhole object, wherein the body comprises a nozzle to project a medium comprising a ferromagnetic material, the nozzle comprising a surface adapted to face the downhole object, and at least two elongated slots extending in a radial direction on the surface;

contacting the downhole object with the medium comprising the ferromagnetic material, thereby associating the downhole object with the ferromagnetic material; and contacting the ferromagnetic material with a retrieval device comprising a magnetic element, thereby associating the downhole object with the retrieval device.

22. The method of claim 21, wherein the medium comprises thermite, and wherein the step of contacting the downhole object with the medium comprises projecting molten thermite into contact with the downhole object, thereby at least partially fusing the ferromagnetic material to the downhole object.

23. The method of claim 21, further comprising the steps of:

projecting the medium through the nozzle in the direction generally parallel to the axis of the wellbore.

24. The method of claim 23, wherein the nozzle comprises a geometry for projecting the medium in a pattern adapted to separate the downhole target into at least two portions associated with the ferromagnetic material.

25. The method of claim 24, wherein the step of projecting the medium separates the downhole object into a plurality of wedge-shaped portions associated with the ferromagnetic material.

26. The method of claim 21, wherein the step of contacting the downhole object with the medium separates the downhole object into at least two portions associated with the ferromagnetic material.

* * * * *